US009421668B2

(12) United States Patent
Lee et al.

(10) Patent No.: US 9,421,668 B2
(45) Date of Patent: Aug. 23, 2016

(54) CMP APPARATUS

(75) Inventors: Seh Kwang Lee, Yongin-si (KR); Youn Chul Kim, Hwaseong-si (KR); Joo Han Lee, Seongnam-si (KR); Jae Kwang Choi, Suwon-si (KR); Jae Phil Boo, Seongnam-si (KR)

(73) Assignees: EHWA DIAMOND INDUSTRIAL CO., LTD., Gyeonggi-Do (KR); SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 14/405,116

(22) PCT Filed: Jun. 7, 2012

(86) PCT No.: PCT/KR2012/004502

§ 371 (c)(1),
(2), (4) Date: Dec. 2, 2014

(87) PCT Pub. No.: WO2013/183799

PCT Pub. Date: Dec. 12, 2013

(65) Prior Publication Data

US 2015/0140900 A1 May 21, 2015

(51) Int. Cl.
*B24B 37/00* (2012.01)
*B24B 49/18* (2006.01)
(Continued)

(52) U.S. Cl.
CPC ..... *B24B 49/186* (2013.01); *B24B 37/005* (2013.01); *B24B 49/18* (2013.01); *B24B 53/017* (2013.01)

(58) Field of Classification Search
CPC ... B24B 49/186; B24B 49/18; B24B 37/005; B24B 53/017
USPC ..... 451/5, 56, 72, 285–290, 443
See application file for complete search history.

(56) References Cited

U.S. PATENT DOCUMENTS 5,399,234 A * 3/1995 Yu ..... B24B 49/00 156/345.13
5,904,608 A * 5/1999 Watanabe ..... B24B 37/005 451/21

(Continued)

FOREIGN PATENT DOCUMENTS

JP 2005-22028 A 1/2005
JP 2007-15107 A 1/2007

(Continued)

OTHER PUBLICATIONS

Korean Office Action dated Jun. 11, 2012, issued to Korean Application No. 10-2011-0053386.

(Continued)

*Primary Examiner* — George Nguyen
(74) *Attorney, Agent, or Firm* — Stein IP, LLC

(57) ABSTRACT

Provided is a chemical mechanical polishing (CMP) apparatus that includes a swing unit installed apart from a platen, on which a CMP pad to be conditioned is placed, at a predetermined interval, a connector installed on an upper end of the swing unit at one end thereof in a perpendicular direction to the swing unit and pivoting around the swing unit above the CMP pad, a rotator rotatably installed on the other end of the connector, a CMP pad conditioner coupled to the rotator and conditioning the CMP pad when rotated, and a vibration meter installed on the connector and detecting vibrations to measure a vibration acceleration of the CMP pad conditioner, thereby predicting a wear rate of the CMP pad based on the vibration acceleration and a state in which the CMP pad conditioner is installed or being used.

14 Claims, 5 Drawing Sheets

(51) Int. Cl.
*B24B 37/005* (2012.01)
*B24B 53/017* (2012.01)

(56) References Cited

U.S. PATENT DOCUMENTS

| | | | | |
|---|---|---|---|---|
| 5,904,609 | A * | 5/1999 | Fukuroda | B24B 37/005 451/285 |
| 6,288,648 | B1 * | 9/2001 | Easter | B24B 53/017 257/618 |
| 6,306,008 | B1 * | 10/2001 | Moore | B24B 49/006 451/41 |
| 6,424,137 | B1 * | 7/2002 | Sampson | B24B 37/013 324/76.21 |
| 6,835,116 | B2 * | 12/2004 | Oguri | B24B 53/017 451/56 |
| 6,896,583 | B2 * | 5/2005 | Rodriquez | B24B 53/017 451/285 |
| 7,163,435 | B2 | 1/2007 | Lim et al. | 451/5 |
| 7,198,542 | B2 | 4/2007 | Kramer et al. | 451/5 |
| 2002/0173223 | A1 * | 11/2002 | Gitis | B24B 37/013 451/5 |
| 2005/0112998 | A1 * | 5/2005 | Matsuo | B24B 49/12 451/5 |
| 2005/0142987 | A1 * | 6/2005 | Kramer | B24B 49/00 451/5 |
| 2006/0172662 | A1 * | 8/2006 | Lim | B24B 53/017 451/5 |
| 2008/0004743 | A1 * | 1/2008 | Goers | B24B 49/02 700/121 |

FOREIGN PATENT DOCUMENTS

| | | | |
|---|---|---|---|
| KR | 1998-084102 | A | 12/1998 |
| KR | 10-2009-0024733 | A | 3/2009 |
| TW | 200819243 | A | 6/1996 |

OTHER PUBLICATIONS

Korean Office Action dated Dec. 12, 2012, issued to Korean Application No. 10-2011-0053386.
International Search Report dated Feb. 20, 2013, issued to corresponding International Application No. PCT/KR2012/004502.
Japanese Office Action dated Feb. 16, 2016, issued by the Japanese Patent Office in corresponding application JP 2015-515920.
Taiwanese Office Action dated May 19, 2014, issued by the Taiwan Intellectual Property Office in corresponding application TW 101120737.

* cited by examiner

CMP APPARATUS

CROSS-REFERENCE TO RELATED APPLICATIONS

This application is a national stage of International Application No. PCT/KR2012/004502, filed Jun. 7, 2012. All disclosures of the document named above is incorporated herein by reference.

BACKGROUND OF THE INVENTION

1. Field of the Invention

The present invention relates, in general, to a chemical mechanical polishing (CMP) apparatus and, more particularly, to a CMP apparatus that measures the vibration acceleration of a CMP pad conditioner for conditioning a CMP pad, thereby making it possible to predict the wear rate of the CMP pad conditioner, to check a state of the CMP pad conditioner, and to maintain the CMP pad conditioner in a steady state.

2. Description of the Related Art

In semiconductor apparatuses, CMP technology is used to flatten thin layers such as insulating layers or metal layers formed on semiconductor wafers.

The main expendable supplies used in a CMP process may include a CMP pad, slurry, and a CMP pad conditioner. Above all, the CMP pad conditioner is equipped with a grinder such as a diamond grinder that makes contact with the CMP pad to scrape or rub a surface of the CMP pad, thereby serving to perform a conditioning function in order to optimize a surface state of a new CMP pad to the initial state in which the ability of the CMP pad to hold the slurry is good or to restore the ability of the CMP pad to hold slurry so as to maintain the polishing capability of the CMP pad in a steady state, and to improve fluidity of the slurry fed to the CMP pad.

In the CMP process, the removal rate of a wafer can be measured, whereas the wear rate of the CMP pad cannot.

A constant wear rate of the CMP pad means that the surface state of the CMP pad is constant. The meaning of "the surface state of the CMP pad is constant" implies the capability of maintaining the removal rate of the wafer constant. Further, when the wear rate of the CMP pad is significantly decreased or increased, this exerts an influence on the removal rate of the wafer as well as defects of the wafer. Thus, it is very important to that the wear rate of the CMP pad be constant in the CMP process.

However, although the wear rate of the CMP pad can be predicted based on the removal rate of the wafer, no apparatus and method capable of predicting the wear rate of the CMP pad have been proposed that exclude a method of measuring the removal rate of the wafer. Further, conventional CMP apparatuses cannot check the state in which the CMP pad conditioner is being used or installed.

Thus, there is a need for a CMP apparatus capable of predicting the wear rate of the CMP pad without measuring the removal rate of the wafer or the state in which the CMP pad conditioner is being used or installed.

SUMMARY OF THE INVENTION

Technical Problem

The inventors have studied solving the above various drawbacks and problems of the related art, and developed a technique capable of predicting the wear rate of the CMP pad by measuring the vibration acceleration of the CMP pad conditioner for conditioning the CMP pad without measuring the removal rate of the wafer. Thereby, the inventors completed the present invention.

Accordingly, an object of the present invention is to provide a CMP apparatus that includes a swing unit installed apart from a platen, on which a CMP pad to be conditioned is placed, at a predetermined interval, a connector installed on an upper end of the swing unit at one end thereof in a perpendicular direction to the swing unit and pivoting around the swing unit above the CMP pad, a rotator rotatably installed on the other end of the connector, a CMP pad conditioner coupled to the rotator and conditioning the CMP pad when rotated, and a Vibration meter (measurement of vibration acceleration)

installed on the connector and detecting vibrations to measure the vibration acceleration of the CMP pad conditioner, thereby predicting the wear rate of the CMP pad based on the vibration acceleration and the state in which the CMP pad conditioner is installed or being used.

The objects of the present invention are not limited to the above-mentioned objects and therefore, other objects and advantages of the present invention that are not mentioned can be understood from the following description by those skilled in the art.

Technical Solution

In order to achieve the above object, the present invention provides a chemical mechanical polishing (CMP) apparatus that measures the vibration acceleration of a CMP pad conditioner for conditioning a CMP pad.

Further, the present invention provides a CMP apparatus that includes: a swing unit installed apart from a platen, on which a CMP pad to be conditioned is placed, at a predetermined interval; a connector installed on an upper end of the swing unit at one end thereof in a perpendicular direction to the swing unit and pivoting around the swing unit above the CMP pad; a rotator rotatably installed on the other end of the connector; a CMP pad conditioner coupled with the rotator and conditioning the CMP pad when rotated; and a Vibration meter (measurement of vibration acceleration)

installed on the connector and detecting vibrations to measure the vibration acceleration of the CMP pad conditioner.

In an exemplary embodiment, the vibration meter may be installed on the connector at any position selected from a position corresponding to the swing unit, a position corresponding to the rotator, and a middle position of the connector.

In an exemplary embodiment, the vibration meter may be installed on the connector at the position corresponding to the rotator.

In an exemplary embodiment, the vibration acceleration of the CMP pad conditioner may be proportional to the wear rate of the CMP pad.

In an exemplary embodiment, the vibration acceleration of the CMP pad conditioner may be adjusted so as to range from 0.06 $m/s^2$ to 5.4 $m/s^2$.

In an exemplary embodiment, when the adjusted vibration acceleration of the CMP pad conditioner is outside the range of 0.06 $m/s^2$ to 5.4 $m/s^2$, the CMP apparatus may be checked or the CMP pad conditioner may be replaced.

In an exemplary embodiment, the CMP apparatus may further include a controller that generates a check signal for the CMP apparatus or a replacement signal for the CMP pad conditioner when the vibration acceleration measured by the vibration meter is outside a previously stored range.

In an exemplary embodiment, the previously stored range of the vibration acceleration may be from 0.06 $m/s^2$ to 5.4 $m/s^2$.

Advantageous Effects

The present invention has excellent effects as follows.

First, according to the CMP apparatus of the present invention, the vibration acceleration of the CMP pad conditioner for conditioning the CMP pad is measured so as to predict the wear rate of the CMP pad.

Further, the CMP apparatus includes a swing unit installed apart from a platen, on which a CMP pad to be conditioned is placed, at a predetermined interval, a connector installed on an upper end of the swing unit at one end thereof in a perpendicular direction to the swing unit and pivoting around the swing unit above the CMP pad, a rotator rotatably installed on the other end of the connector, a CMP pad conditioner coupled to the rotator and conditioning the CMP pad when rotated, and a vibration meter installed on the connector and detecting vibration to measure a vibration acceleration of the CMP pad conditioner, thereby predicting the wear rate of the CMP pad based on the vibration acceleration and the state in which the CMP pad conditioner is installed or being used.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
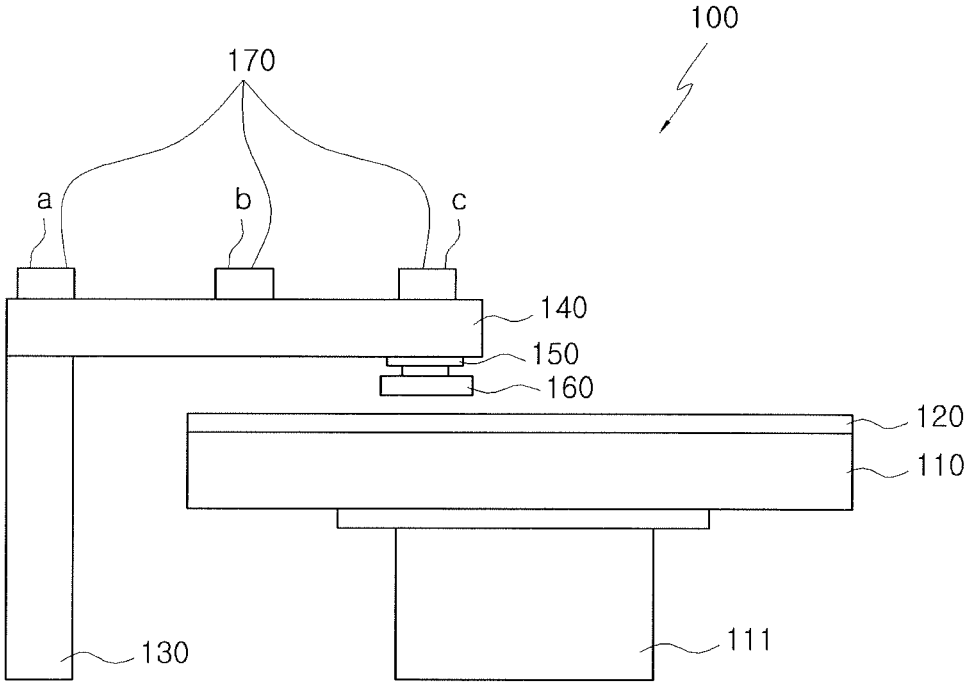
FIG. 1 shows a schematic structure of a CMP apparatus according to an embodiment of the present invention.

The terms used herein are selected from ordinary terms that are commonly used at present if possible. However, some of the terms are arbitrarily selected by the applicant. In this case, they should be construed as having the meanings set forth or used in the detailed description of the present invention rather than the simple lexical meanings.

Reference will now be made in greater detail to exemplary embodiments of the present invention with reference to the accompanying drawings.

However, the present invention is not limited to the embodiments described herein, but may be embodied in different forms. Throughout the specification, it should be noted that the same reference numerals used to describe the present invention will designate similar or equivalent components.

The present invention is directed to a chemical mechanical polishing (CMP) apparatus that measures the vibration acceleration of a CMP pad conditioner for conditioning a CMP pad, and predicts the wear rate of the CMP pad based on the measured vibration acceleration and the state in which the CMP pad conditioner is installed or being used.

In a CMP process, the vibration acceleration of the CMP pad conditioner is measured without separately measuring the removal rate of a wafer. This allows the wear rate of the CMP pad to be predicted when the wafer is polished, so that the service life of the CMP pad conditioner can be predicted. Further, by measuring the vibration acceleration of the CMP pad conditioner, it is possible to determine whether or not the use or installation of the CMP pad conditioner is normal. As such, the CMP apparatus can be maintained in a steady state.

Figure 2:
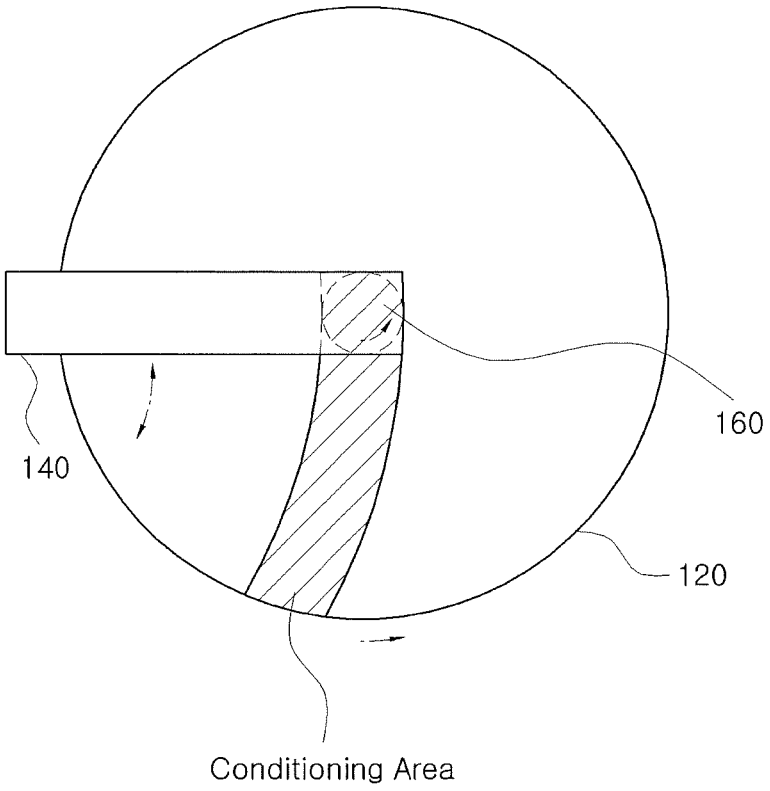
FIG. 2 shows a conditioning area of a CMP pad conditioner according to an embodiment of the present invention.

FIG. 1 shows a schematic structure of a CMP apparatus according to an embodiment of the present invention. FIG. 2 shows a conditioning area of a CMP pad conditioner according to an embodiment of the present invention. The CMP apparatus 100 includes a swing unit 130, a connector 140, a rotator 150, a CMP pad conditioner 160, and a Vibration meter (measurement of vibration acceleration) 170.

The swing unit 130 is installed apart from a platen 110, on which a CMP pad 120 to be conditioned is placed, at a predetermined interval. For example, the platen 110 is installed on a support 111 in parallel to a horizontal floor. The swing unit 130 is vertically installed on the floor. Although not shown, the swing unit 130 includes a separate motor, and is rotated about a swing axis by the motor.

The connector 140 is installed on an upper end of the swing unit 130 at one end thereof, The connector 140 is installed in a perpendicular direction to the swing unit 130, and pivots around the swing unit 130 above the CMP pad 120 at a predetermined angle.

The rotator 150 is rotatably installed on the other end of the connector 140. Although not shown, the rotator 150 includes a separate motor, and is rotated about a swing axis by the motor.

The CMP pad conditioner 160 is coupled with the rotator 150, and conditions the CMP pad 120 when rotated by the rotator 150. The conditioning process refers to a process in which, when the CMP pad conditioner 160 is brought into close contact with the CMP pad 120, the CMP pad conditioner 160 rotates to scratch or rub a surface of the CMP pad 120 to optimize a surface state of the CMP pad in an initial state, or to restore the removal capability of the CMP pad so as to maintain a steady state.

A conditioning area shown in FIG. 2 indicates an area in which the CMP pad conditioner 160 conditions the CMP pad when pivoted by the connector 140. The CMP pad conditioner 160 is pivoted when rotated, and simultaneously the platen 110 is also rotated. As such, the CMP pad conditioner 160 can condition the entire surface of the CMP pad 120.

The vibration meter 170 is installed on the connector 140, and detects vibrations to measure the vibration acceleration of the CMP pad conditioner 160.

In detail, referring to FIG. 1, the vibration meter 170 may be installed at any one position of the connector 140 selected from a position A corresponding to the swing unit 130, a position C corresponding to the rotator 150, and a middle position B of the connector 140.

Even when the vibration meter 170 is installed at any one of the positions A, B, and C, the vibration meter 170 can measure the vibration acceleration of the CMP pad conditioner 160 although there is a difference in sensitivity caused by vibration.

The following are some experimental examples for checking which there is a relation between the vibration acceleration of the CMP pad conditioner 160 and the wear rate of the CMP pad in the CMP process.

Experimental Example 1

In the CMP process, the CMP pad 120 brought into close contact with the CMP pad conditioner 160 was conditioned by applying a load to the CMP pad conditioner 160. A different method of applying the load to the CMP pad conditioner 160 is used by each of manufacturers of the CMP apparatus. Here, a method using air, a method using a shaft, and a method using a weight will be described.

First, in the method using air, the same amount of air fills the entire CMP pad conditioner 160 and presses the CMP pad 120. In the method using a shaft, air pressurizes a rotary shaft (not shown) of the rotator 150, and the pressurized rotary shaft transfers force to the center of the CMP pad conditioner 160. In the method using a weight, a predetermined weight is placed on a rotary shaft of the CMP pad conditioner 160, and transfers force to the rotary shaft of the CMP pad conditioner 160.

Table 1 indicates the vibration acceleration of the CMP pad conditioner 160 and the resulting wear rate of the CMP pad according to each load transfer method.

Hereinafter, referred to as "pad wear rate (PWR)"

TABLE 1

| Load Transfer Method | PWR (μm/hr) | Vibration Acceleration ($m/s^2$) |
|---|---|---|
| Air Method | 17.0 | 0.4 |
| Shaft Method | 20.0 | 0.5 |
| Weight Method | 28.0 | 1.0 |

Figure 3:
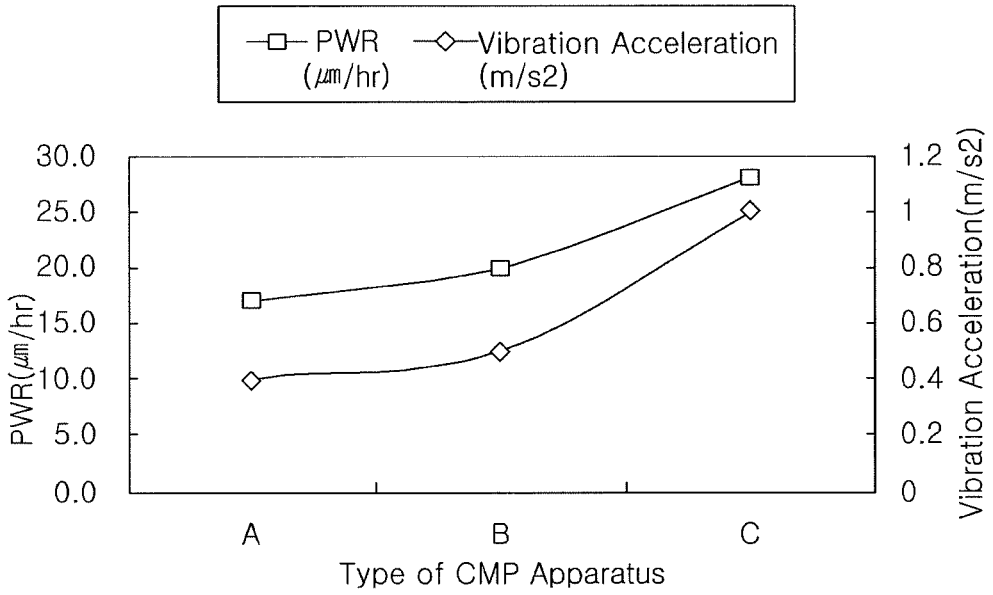
FIG. 3 is a graph depicting a PWR (pad wear rate) and the vibration acceleration according to a method of applying a load to a CMP pad conditioner.

When the load of 6 lbf is applied to the CMP pad conditioner 160 without changing the other process conditions, it can be found that, as set forth in Table 1, although the same load is applied in a stationary state, the PWR and the vibration acceleration are different depending on the load transfer method. Referring to Table 1 and FIG. 3, it can be found that the PWR and the vibration acceleration are proportional to each other.

That is, the CMP apparatuses have different PWR and vibration acceleration depending on the load transfer method. As such, it can be found that different loads are applied to the CMP pad conditioner to control the PWRs of the different CMP apparatuses 100 at the same level.

Experimental Example 2

On the basis of the results of Experimental Example 1, loads applied to the CMP pad conditioner 160 and the resulting PWRs were measured so as to have the same vibration acceleration as Experimental Example 1 using a load transfer apparatus using air, for instance a load transfer apparatus A, and the results are given in Table 2.

TABLE 2

| Vibration Acceleration ($m/s^2$) | Disc Load (lbf) | PWR (μm/hr) | PWR of Experimental Example 1 |
|---|---|---|---|
| 0.4 | 6.0 | 17.0 | 17.0 |
| 0.5 | 6.7 | 19.8 | 20.0 |
| 1.0 | 8.8 | 28.4 | 28.0 |

Loads were applied to a disc of the CMP pad conditioner 160 so as to have the vibration acceleration of 0.4, 0.5 and 1.0 $m/s^2$ as set forth in Table 1. As a result, the PWRs of 17.0, 19.8, and 28.4 μm/hr were measured. These PWRs are nearly equal to those of Experimental Example 1.

That is, when the load applied to the disc is adjusted to equalize the vibration acceleration, the PWR can be adjusted to the same level as the other CMP apparatuses. It can be found that, on the basis of this principle, the vibration acceleration is measured, and thereby the PWR can be predicted.

Experimental Example 3

A load of 6 lbf was applied to the CMP pad conditioner 160 using a load transfer apparatus A, and a tolerance was given to a rotary shaft (not shown) transferring the load to the CMP pad conditioner 160, thereby generating vibration artificially. In this case, when vibration accelerations became equal to those of Experimental Example 1, PWRs were measured. The results are given in Table 3.

TABLE 3

| Disc Load (lbf) | Vibration Acceleration ($m/s^2$) | PWR (μm/hr) | PWR of Experimental Example 1 |
|---|---|---|---|
| 6.0 | 0.4 | 17.0 | 17.0 |
| 6.0 | 0.5 | 19.7 | 20.0 |
| 6.0 | 1.0 | 28.2 | 28.0 |

It can be found that, as set forth in Table 3, even when the same load is applied to the CMP pad conditioner 160, the PWR varies with a change in the vibration acceleration. Thus, it can be seen that the PWR can be predicted from the vibration acceleration of the CMP pad conditioner 160. In addition, the vibration meter 170 was installed on the rotator 150, and the vibration acceleration of the CMP pad conditioner 160 was measured. Thereby, the CMP apparatus 100 could be set so as to check a state of the CMP apparatus 100 and to have a uniform PWR.

Experimental Example 4

When different loads were applied to the CMP pad conditioner 160 using a load transfer apparatus A, vibration acceleration and the resulting PWRs were measured. The results are given in Table 4.

TABLE 4

| Disc Load (lbf) | Vibration Acceleration ($m/s^2$) | PWR (μm/hr) |
|---|---|---|
| 4.0 | 0.25 | 12.4 |
| 6.0 | 0.4 | 17.0 |
| 8.0 | 0.62 | 20.6 |
| 10.0 | 0.81 | 24.3 |
| 12.0 | 1.0 | 28.5 |

Figure 4:
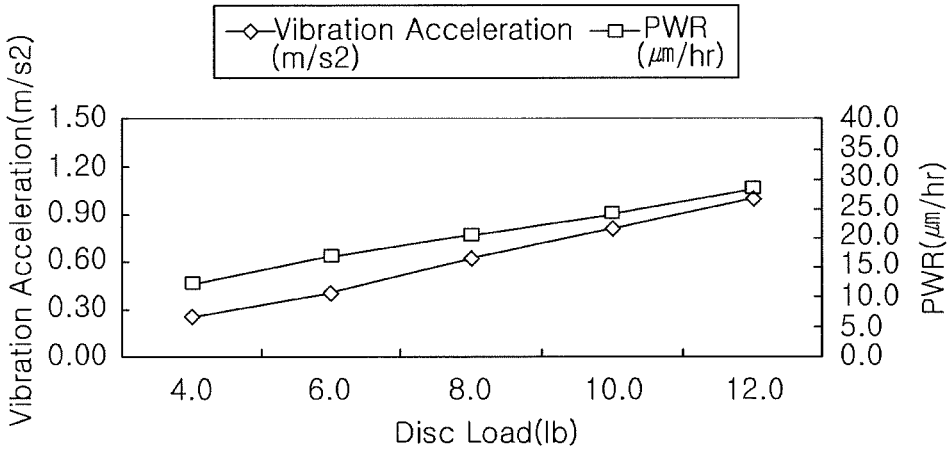
FIGS. 4 and 5 are graphs depicting a PWR (pad wear rate) and the vibration acceleration according to a load applied to a CMP pad conditioner.

It can be found that, as set forth in Table 4, the vibration acceleration is proportional to the load applied to the CMP pad conditioner 160, and that the PWR of the CMP pad 120 can be predicted by measuring the vibration acceleration. This can be seen from FIG. 4 that shows the measurements of Table 4 in a graph Experimental Example 5

When different loads were applied to the CMP pad conditioner 160 using a load transfer apparatus A, vibration accelerations, the resulting PWRs, removal rates of oxide wafers, and defects of the wafers were measured. The results are given in Table 5.

TABLE 5

| Disc Load (lbf) | Vibration Acceleration ($m/s^2$) | PWR (μm/hr) | Wafer Removal Rate (Å/min) | Number of Wafer Defects (ea) | Pad Profile |
|---|---|---|---|---|---|
| 2.0 | 0.06 | 2.7 | 2200 | 120 | Normal |
| 3.0 | 0.15 | 8 | 2700 | 5 | Normal |
| 4.0 | 0.25 | 12.4 | 2755 | 5 | Normal |
| 6.0 | 0.4 | 17.0 | 2762 | 4 | Normal |
| 8.0 | 0.62 | 20.6 | 2795 | 2 | Normal |
| 10.0 | 0.81 | 24.3 | 2788 | 2 | Normal |
| 12.0 | 1.0 | 28.5 | 2782 | 6 | Normal |
| 20.0 | 4.0 | 55.0 | 2766 | 5 | Normal |
| 25.0 | 5.4 | 93.0 | 2588 | 21 | Uneven Wear |

Figure 5:
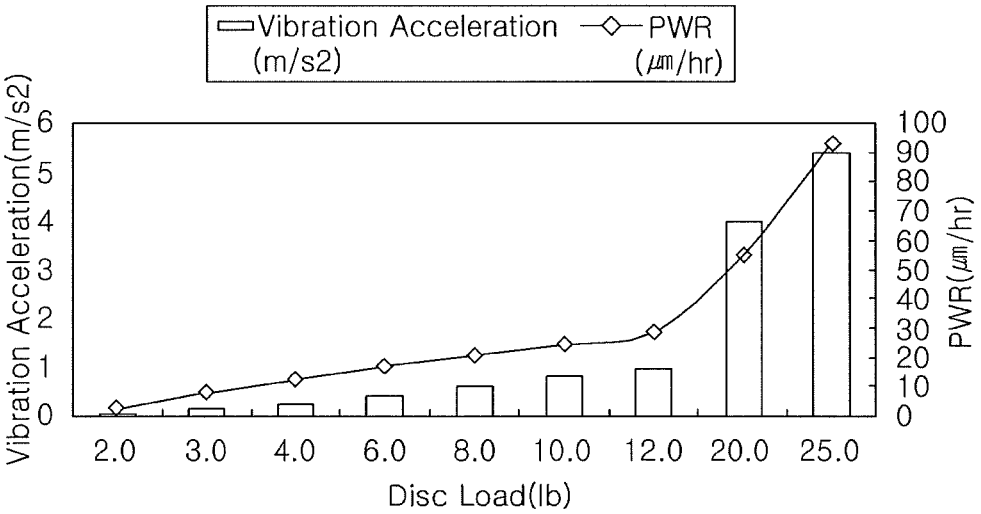

The disc loads of Table 5 were measured including 4.0, 6.0, 8.0, 10.0, and 12.0 lbf that are the disc loads of Table 4, as well as loads smaller than 4.0 lbf and loads greater than 12.0 lbf. The vibration accelerations when the disc loads were 4.0, 6.0, 8.0, 10.0, and 12.0 lbf were measured and were equal to those of Table 4, and the resulting PWRs were also equal to those of Table 4. The vibration acceleration based on the disc loads and the resulting PWRs, which are set forth in Table 4, are also shown in FIG. 5.

When the vibration acceleration was 0.06 $m/s^2$, it could be found that conditioning was not smoothly performed, so that the wafer removal rate was low, and the defect of the wafer was increased.

On the other hand, when the vibration acceleration was 5.4 $m/s^2$, it could be found that the PWR was very high, that the pad profile was not uniform, i.e. the CMP pad 120 was subjected to uneven wear, and that a service life of the CMP pad 120 was shortened.

Figure 6:
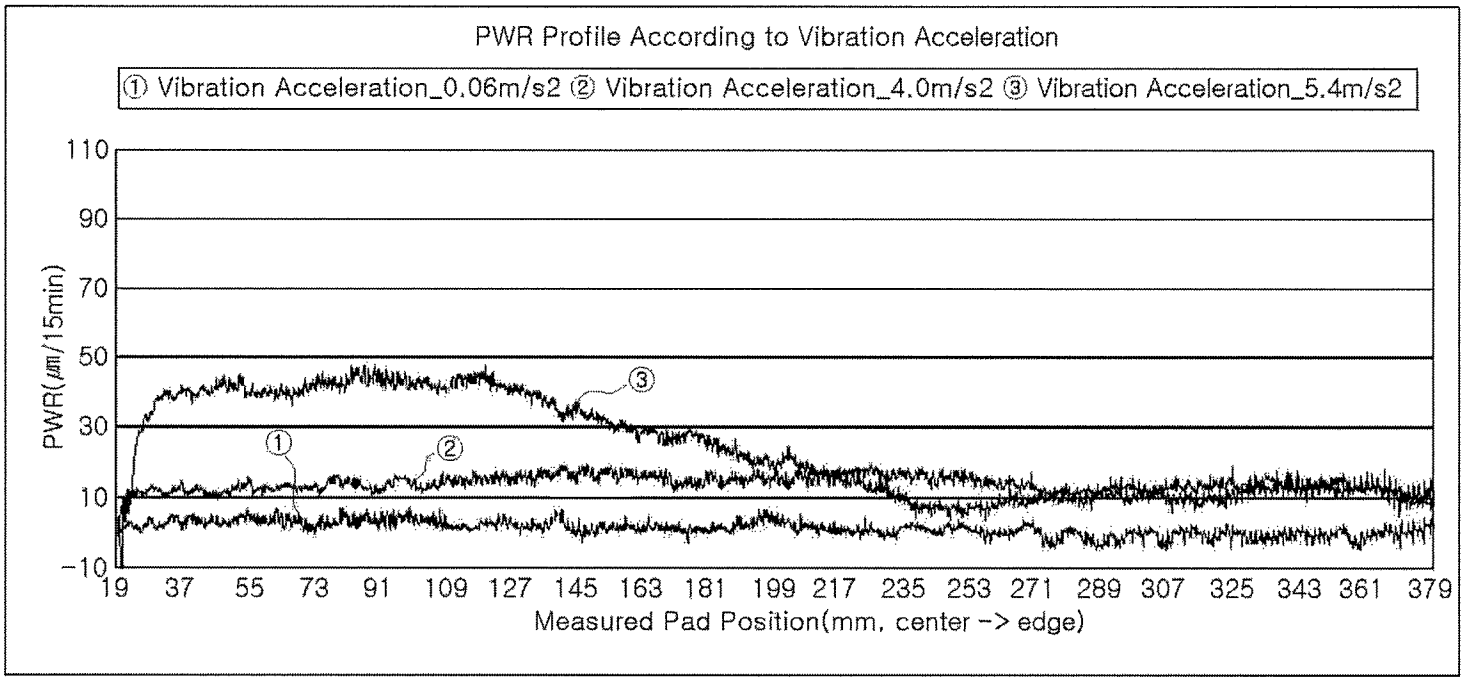
FIG. 6 is a graph depicting a profile of a PWR (pad wear rate) according to the vibration acceleration.

As a result, it can be found that the vibration acceleration measured by detecting the vibration of the CMP pad conditioner 160 has a range from 0.06 to 5.4. Referring to FIG. 6, a profile of the PWR depending on the vibration acceleration can be ascertained. It can be found that the profile when the vibration acceleration is 0.06 $m/s^2$ or 4.0 $m/s^2$ is uniform on the whole, whereas the profile when the vibration acceleration is 5.4 $m/s^2$ is not uniform.

Experimental Example 6

To check a change in sensitivity of the vibration meter 170 according to a position at which the vibration meter 170 was installed, the vibration meters 170 were installed on the connector 140 at a position corresponding to the swing unit 130, a position corresponding to the rotator 150, and a middle position of the connector 140. Loads of 4, 6, and 8 lbf were applied to the CMP pad conditioner 160, and then vibration acceleration was measured to examine sensitivity (deviation). The results are given in Table 6.

TABLE 6

| Position of Vibration Meter | Vibration Acceleration ($m/s^2$) 8 lbf | 6 lbf | 4 lbf | sensitivity (deviation) |
|---|---|---|---|---|
| A (corresponding to swing unit) | 0.25 | 0.22 | 0.19 | 0.06 |
| B (middle position of connector) | 0.40 | 0.36 | 0.32 | 0.08 |
| C (corresponding to rotator) | 0.62 | 0.55 | 0.42 | 0.20 |

Referring to FIG. 1, as set forth in Table 6, when the vibration meter 170 is installed on the connector 140 at the position A corresponding to the swing unit 130, the vibration acceleration measured when the loads of 4, 6, and 8 lbf are applied to the CMP pad conditioner 160 has a sensitivity of 0.06. Here, the sensitivity is defined as a difference between the maximum and minimum vibration accelerations.

Similarly, when the vibration meter 170 is installed on the connector 140 at middle position B of the connector 140, the measured vibration acceleration has a sensitivity of 0.08. When the vibration meter 170 is installed on the connector 140 at the position C corresponding to the rotator 150, the measured vibration acceleration has a sensitivity of 0.20.

That is, when the vibration meter 170 is installed on the connector 140 at position C corresponding to the rotator 150, the measured vibration acceleration has the highest sensitivity. As such, to accurately determine whether the state of the CMP apparatus is normal and to sensitively detect the vibration of the CMP pad conditioner 160, the vibration meter 170 is preferably installed on the connector 140 at position C corresponding to the rotator 150.

Consequently, the vibration acceleration of the CMP pad conditioner 160 can be set to have a range, for instance from 0.06 $m/s^2$ to 5.4 $m/s^2$, within which the wafer removal rate, the number of wafer defects, the PWR, and the pad profile are satisfactorily provided by adjusting the load applied to the CMP pad conditioner 160, the method of applying the load to the CMP pad conditioner 160, the tolerance of the rotator 150 when the CMP pad conditioner 160 is installed, and the position at which the vibration meter 170 is installed.

This may be manually set by a worker, or be automatically set using a controller (not shown). The controller will be described below.

Further, if the vibration acceleration is not adjusted so as to be in the range from 0.06 $m/s^2$ to 5.4 $m/s^2$ in spite of the use of the above method, the worker can replace the CMP pad conditioner 160.

In addition, a different method of applying the load to the CMP pad conditioner is used by each manufacturer of the CMP apparatus. As such, when a predetermined load is applied to the CMP pad conditioner, the same load can be transferred to the CMP pad conditioner when the CMP pad conditioner is in the stopped state. However, when the connector pivots to swing the CMP pad conditioner, the load transferred to the CMP pad conditioner varies.

Further, even when the load is applied to the CMP pad conditioner in the same way, the vibrations detected by the vibration meter are different from each other due to the tolerance generated when the CMP pad conditioner is installed.

The present invention can constantly adjust the vibration accelerations of different CMP pad conditioners by adjusting the load of the CMP pad conditioner, the method of applying the load to the CMP pad conditioner, the tolerance of the rotator when the CMP pad conditioner is installed, and the position at which the vibration meter is installed. Thereby, the PWRs of different CMP apparatuses can be maintained constant. Finally, the deviation of the wafer removal rate between the different CMP apparatuses can be reduced.

Meanwhile, the CMP apparatus may further include a controller (not shown).

In the CMP apparatus 100 of the present invention, the range of the vibration acceleration is previously stored, and the vibration acceleration measured by the vibration meter 170 is compared with this previously stored vibration acceleration. If the measured vibration acceleration falls outside the previously stored range of the vibration acceleration, the controller generates a check signal for checking the CMP apparatus 100, or a replacement signal for replacing the CMP pad conditioner 160.

When the controller generates the check signal, the load of the CMP pad conditioner, the method of applying the load to the CMP pad conditioner, the tolerance of the rotator when the CMP pad conditioner is installed, and the position at which the vibration meter is installed are adjusted, so that the CMP apparatus 100 can be checked so as to allow the measured vibration acceleration to be put within the previously stored range of the vibration acceleration.

Here, the previously stored range of the vibration acceleration is preferably between 0.06 $m/s^2$ and 5.4 $m/s^2$, as verified in the experimental examples.

When the CMP apparatus 100 is checked using various methods so as to allow the measured vibration acceleration to be put within the previously stored range of the vibration acceleration, the measured vibration acceleration may deviate from the previously stored range of the vibration acceleration. From this it can be concluded that the service life of the CMP pad conditioner 160 is over. Thus, the controller generates a replacement signal to prompt the worker to replace the CMP pad conditioner 160.

While the present invention has been particularly shown and described with reference to exemplary embodiments thereof, it is not limited to the embodiments. Thus, it will be understood by those of ordinary skill in the art that various modifications or changes may be made thereto without departing from the spirit and scope of the present invention as defined by the following claims.

The invention claimed is:

1. A chemical mechanical polishing (CMP) apparatus that measures a vibration acceleration of a CMP pad conditioner conditioning a CMP pad comprising:

a vibration meter detecting vibrations to measure a vibration acceleration of the CMP pad conditioner; and a controller that generates a check signal for the CMP apparatus or a replacement signal for the CMP pad conditioner when a vibration acceleration measured by the vibration meter is outside a previously stored range of the vibration acceleration, wherein when the check signal is generated, the controller adjusts process conditions affecting the vibration acceleration comprising the load of the CMP pad conditioner, the method of applying the load to the CMP pad conditioner, the tolerance of the rotator when the CMP pad conditioner is installed, and the position at which the vibration meter is installed, and checks so as to allow the measured vibration acceleration to be put within the previously stored range of the vibration acceleration, and when the measured vibration acceleration after adjusting the process conditions deviates from the previously stored range of the vibration acceleration, the controller generates the replacement signal.

2. A CMP apparatus comprising:

a swing unit installed apart from a platen, on which a CMP pad to be conditioned is placed, at a predetermined interval;

a connector installed on an upper end of the swing unit at one end thereof in a perpendicular direction to the swing unit and pivoting around the swing unit above the CMP pad;

a rotator rotatably installed on the other end of the connector;

a CMP pad conditioner coupled with the rotator and conditioning the CMP pad when rotated;

a vibration meter installed on the connector and detecting vibrations to measure a vibration acceleration of the CMP pad conditioner; and a controller that generates a check signal for the CMP apparatus or a replacement signal for the CMP pad conditioner when the vibration acceleration measured by the vibration meter is outside a previously stored range of the vibration acceleration, wherein when the check signal is generated, the controller adjusts process conditions affecting the vibration acceleration comprising the load of the CMP pad conditioner, the method of applying the load to the CMP pad conditioner, the tolerance of the rotator when the CMP pad conditioner is installed, and the position at which the vibration meter is installed, and checks so as to allow the measured vibration acceleration to be put within the previously stored range of the vibration acceleration, and when the measured vibration acceleration after adjusting the process condition may deviate from the previously stored range of the vibration acceleration, the controller generates the replacement signal.

3. The CMP apparatus according to claim 2, wherein the vibration meter is installed on the connector at any position selected from a position corresponding to the swing unit, a position corresponding to the rotator, and a middle position of the connector.

4. The CMP apparatus according to claim 3, wherein the vibration meter is installed on the connector at the position corresponding to the rotator.

5. The CMP apparatus according to claim 2, wherein the vibration acceleration of the CMP pad conditioner is proportional to a wear rate of the CMP pad.

6. The CMP apparatus according to claim 5, wherein the vibration acceleration of the CMP pad conditioner is adjusted so as to be in a range from 0.06 $m/s^2$ to 5.4 $m/s^2$.

7. The CMP apparatus according to claim 6, wherein, when the adjusted vibration acceleration of the CMP pad conditioner is outside the range of 0.06 $m/s^2$ to 5.4 $m/s^2$, the CMP apparatus is checked or the CMP pad conditioner is replaced.

8. The CMP apparatus according to claim 2, wherein the previously stored range of the vibration acceleration is from 0.06 $m/s^2$ to 5.4 $m/s^2$.

9. The CMP apparatus according to claim 3, wherein the previously stored range of the vibration acceleration is from 0.06 $m/s^2$ to 5.4 $m/s^2$.

10. The CMP apparatus according to claim 4, wherein the previously stored range of the vibration acceleration is from 0.06 $m/s^2$ to 5.4 $m/s^2$.

11. The CMP apparatus according to claim 5, wherein the previously stored range of the vibration acceleration is from 0.06 $m/s^2$ to 5.4 $m/s^2$.

12. The CMP apparatus according to claim 6, wherein the previously stored range of the vibration acceleration is from 0.06 $m/s^2$ to 5.4 $m/s^2$.

13. The CMP apparatus according to claim 7, wherein the previously stored range of the vibration acceleration is from 0.06 $m/s^2$ to 5.4 $m/s^2$.

14. The CMP apparatus according to claim 1, wherein the previously stored range of the vibration acceleration is from 0.06 $m/s^2$ to 5.4 $m/s^2$.

* * * * *